US005117912A

United States Patent [19]

Young

[11] Patent Number: 5,117,912

[45] Date of Patent: Jun. 2, 1992

[54] METHOD OF POSITIONING TUBING WITHIN A HORIZONTAL WELL

[75] Inventor: Craig E. Young, Midland, Tex.

[73] Assignee: Marathon Oil Company, Findlay, Ohio

[21] Appl. No.: 705,461

[22] Filed: May 24, 1991

[51] Int. Cl.[5] ..... E21B 43/25

[52] U.S. Cl. ..... 166/305.1; 166/384; 166/331; 166/118; 166/119

[58] Field of Search ..... 166/305.1, 312, 50, 166/72, 120, 242

[56] References Cited

U.S. PATENT DOCUMENTS

| | | | |
|---|---|---|---|
| 970,812 | 9/1910 | Graham . | |
| 2,295,418 | 9/1942 | Mims | 166/1 |
| 2,397,070 | 3/1946 | Zublin | 166/4 |
| 3,620,457 | 11/1971 | Pearson | 239/589 |
| 4,089,371 | 5/1978 | Decuir, Sr. | 166/242 |
| 4,168,752 | 9/1979 | Sabol | 175/12 |
| 4,532,994 | 8/1985 | Toma et al. | 166/50 X |
| 4,744,420 | 5/1988 | Patterson et al. | 166/312 |
| 4,813,611 | 3/1989 | Fontana | 239/589 |
| 4,909,325 | 3/1990 | Hopmann | 166/312 |
| 4,936,387 | 6/1990 | Rubbo | 166/120 X |
| 5,029,642 | 7/1991 | Crawford | 166/72 |

*Primary Examiner*—Terry Lee Melius
*Assistant Examiner*—Frank S. Tsay
*Attorney, Agent, or Firm*—Jack L. Hummel; Jack E. Ebel

[57] ABSTRACT

A method of selectively and variably positioning tubing within the generally horizontal section of a horizontally drilled well. A tubing string having a guide shoe secured to the end thereof is inserted into a portion of the horizontal section of a horizontal well. Smaller diameter tubing is then inserted through the tubing string and past guide shoe into the generally horizontal section. The smaller diameter tubing can be inserted to a point proximate the end of the horizontal section of the well or intermediate between the end and the guide shoe. The subterranean formation surrounding the generally horizontal section may be stimulated or treated by injecting a fluid via the smaller diameter tubing.

23 Claims, 5 Drawing Sheets

METHOD OF POSITIONING TUBING WITHIN A HORIZONTAL WELL

BACKGROUND OF THE INVENTION

The present invention relates to a method of selectively and variably positioning tubing within and along substantially the entire length of the generally horizontal section of a horizontally drilled well, and more particularly, to a method for stimulating and/or treating the horizontal section of a horizontally drilled well.

In recent years, horizontally drilled wells have been increasingly utilized to recover significant amounts of liquid hydrocarbons from fractured subterranean hydrocarbon-bearing formations. In drilling a horizontal well bore, a generally vertical well bore is first drilled from the surface to a depth approximating the subterranean hydrocarbon-bearing formation of interest. The well bore is then deviated through a curve section and terminated in a generally horizontal direction. In horizontal wells having medium to large radius of curvatures, i.e., greater than 16 meters, the well can be completed by positioning casing through the vertical and curve sections and into the horizontal section of the well bore. The casing is then cemented and the well is placed in fluid communication with the formation by any suitable means, such as, by perforating. In horizontal wells having a relatively small radius of curvature, e.g., less than 16 meters, casing cannot be cemented effectively through the curved section of the well bore, and accordingly, the generally horizontal section of the well bore is usually completed open hole, i.e. without cement casing.

Alternatively, a horizontal drainhole can be drilled from an existing vertical well which is usually cased. The casing of the vertical well is packed off and is provided with a whipstock. A portion of the casing above the whipstock is milled away to provide a window for drilling access. The whipstock assists the drill string which is equipped with flexible drill collars or the like in drilling the curve section. Directional survey tools can be used to locate the path of the subsequently drilled drainhole. As with newly drilled wells, drainholes having a relatively short radius of curvature cannot be completed with effectively cemented casing.

The use of a smaller diameter tubing string has been proposed to complete horizontally drilled wells having a relatively small radius of curvature. In accordance with this proposed technique, the tubing string is equipped with a bull plug or cap at the lower end thereof. This bull plug provides a rounded peripheral configuration which prevents the tubing from becoming stuck in the well bore walls of the curve section of the horizontal well and thus permits the tubing string to be positioned within the horizontal section of the horizontal well. However, the end of the tubing usually cannot be positioned at or near the end of the horizontal section of the horizontal well. Often the horizontal section of the well is incongruous and thus does not permit the tubing string to pass through the entire length. thereof. And since a tubing string is usually bent while passing through the short radius of curvature of a radius section of a horizontal well, the bent tubing string usually encounters the top of the well bore wall in the horizontal section of the well and becomes stuck. Also, a portion of the horizontal section of a horizontal well may be drilled upwardly into the gas cap of a subterranean hydrocarbon-bearing formation. In such instances, the tubing would be inserted only into that portion of the horizontal section of the well which exists within the oil-bearing zone of the formation. Thus, as the bull plug or cap prevents movement through the tubing, treatment of the horizontal section of a horizontal well bore existing beyond the end of tubing has been problematic. Therefore, a need exists for a method for selectively and variably treating that portion of the horizontal section of a horizontal well bore which extends beyond the end of tubing positioned within the horizontal section.

Accordingly, it is an object of the present invention to provide a method for selectively and variably placing tubing within the generally horizontal section of a horizontally drilled well.

It is a further object of the present invention to provide a method for stimulating and/or treating the generally horizontal section of a horizontally drilled well.

SUMMARY OF INVENTION

To achieve the foregoing and other objects, and in accordance with the purposes of the present invention, as embodied and broadly described herein, one embodiment, the method of the present invention, relates to a method of variably and selectively positioning coil tubing in a horizontally drilled well which has a generally vertical section, a curve section and a generally horizontal section. The method comprises securing a generally hollow tubing guide shoe to one end of a tubing string and inserting said tubing guide shoe and a portion of said tubing string through said generally vertical section and said curve section and into a portion of said generally horizontal section. Coil tubing is inserted through said tubing string such that a portion of said coil tubing extends through said tubing guide shoe and into the generally horizontal section of said well.

In another embodiment of the present invention, a method is provided for stimulating and/or treating a subterranean formation penetrated by a horizontally drilled well which has a generally vertical section, a curve section, and a generally horizontal section. The method comprises securing a generally hollow tubing guide shoe to one end of a tubing string. The tubing guide shoe and a portion of said tubing string are inserted through said generally vertical section and said curve section and into a portion of said generally horizontal section. Coil tubing is inserted through said tubing string such that a portion of said coil tubing extends through said tubing guide shoe and into the generally horizontal section of the well. A stimulating and/or treating solution is injected through said coil tubing so as to stimulate and/or to treat said subterranean formation surrounding said generally horizontal section of the well.

In yet another embodiment of the present invention, a method is provided for treating a subterranean formation penetrated by a horizontally drilled well which has a generally vertical section, a curve section and a generally horizontal section. The method comprises inserting a tubing string having a generally hollow tubing guide shoe secured to the end thereof and a ported "J" nipple positioned intermediate the length thereof through said generally vertical section and said curve section and into a portion of said horizontal section. An annulus defined between said tubing string and said vertical section is sealed to prevent fluid flow therethrough. An annulus defined between said tubing string and said horizontal section is also sealed to prevent fluid flow therethrough. A treating solution is injected through said tubing string and said ported "J" nipple and into a portion of said formation between the points at which said annulus are sealed.

BRIEF DESCRIPTION OF THE DRAWINGS

The accompanying drawings, which are incorporated in and form a part of the specification, illustrate the embodiments of the present invention and, together with the description, serve to explain the principles of the invention.

In the drawings.

DETAILED DESCRIPTION OF THE PREFERRED EMBODIMENTS

Figure 1:
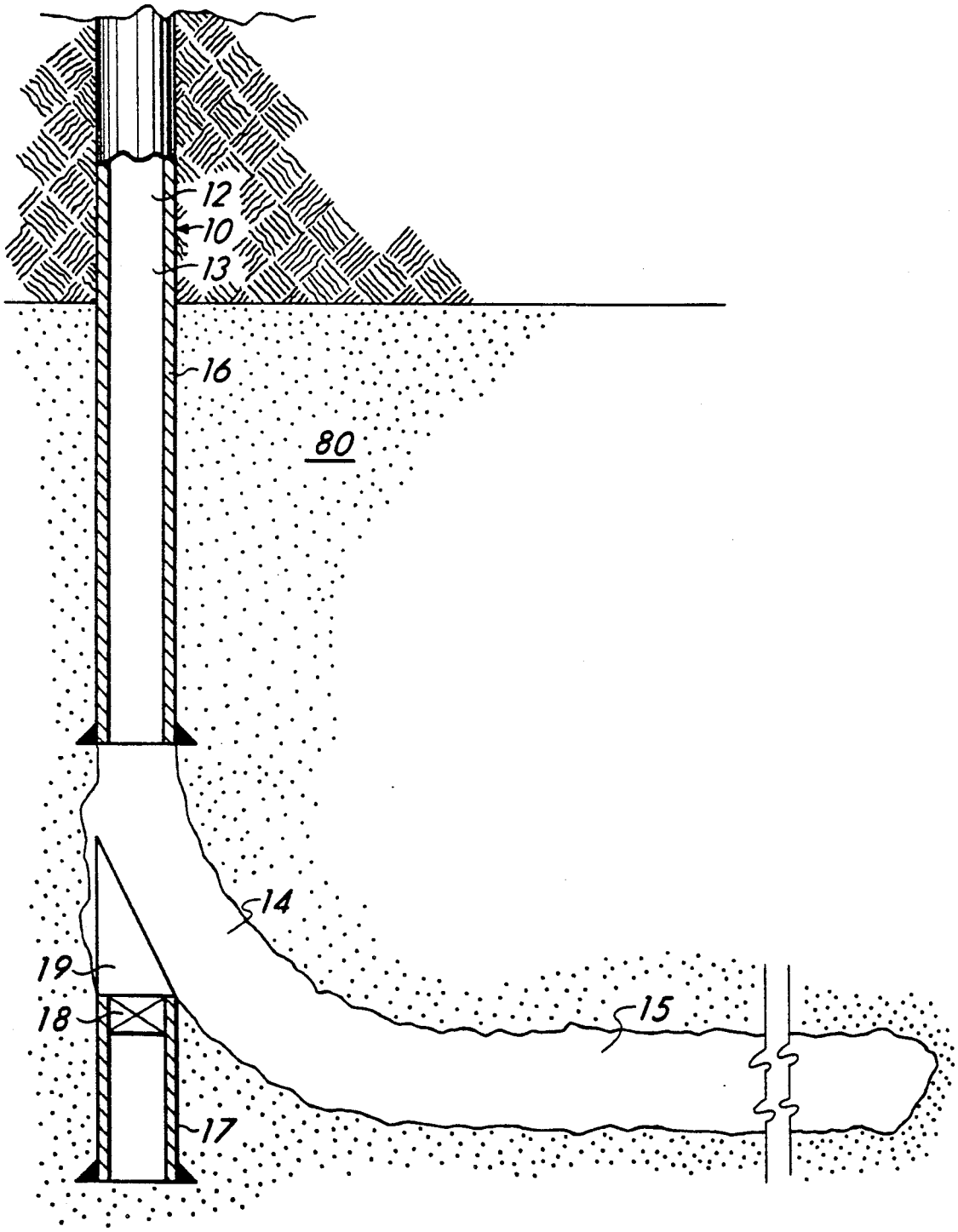
FIG. 1 is a sectional view of a horizontal well penetrating a subterranean hydrocarbon-bearing formation.

Referring to FIG. 1, a horizontal well is illustrated generally as 10 and comprises a well bore 12 having a generally vertical section 13, a curve or radius section 14, and a generally horizontal section 15. A horizontal well is usually a new well which is drilled from the surface and has a horizontal section length of approximately 300 to 1000 meters. A horizontal well may also be drainhole which is horizontally drilled from an existing vertical well and has a length of approximately 30 to 250 meters. Multiple drain holes may be drilled from one vertical well. As utilized throughout the specification, the term "horizontal well" and "horizontally drilled well" interchangeably refer to both horizontal wells which are newly drilled from the surface and to drainhole(s) which are drilled from an existing vertical well. In addition, both "horizontal well" and "horizontally drilled well" refer to a well having a relatively short radius of curvature of from about 4 to about 16 meters. Although curve section 14, generally horizontal section 15 and a portion of vertical section 13 are illustrated in FIGS. 1 and 3–5 as being within a hydrocarbon-bearing formation 80, the thickness of hydrocarbon-bearing formation 80 and the radius of curvature of curve section 14 will determine whether or not vertical section 13, curve section 14 or any portion thereof are drilled through formation 80. However, it is generally desired to drill the generally horizontal section 15 entirely within formation 80. As previously mentioned, present drilling techniques and apparatus usually result in a relatively incongruous horizontal section which preferably is entirely within formation 80.

Vertical section 13 is provided with casing 16 which is secured therein by any suitable means, such as cement. The lower end of vertical section 13 is provided with a second section of casing 17 having a mechanical packer 18 sealing the lower portion thereof. Positioned above mechanical packer 18 is a whipstock 19 to provide proper depth and radial orientation for entry into the curve portion 14 of horizontal well 10.

Figure 2:
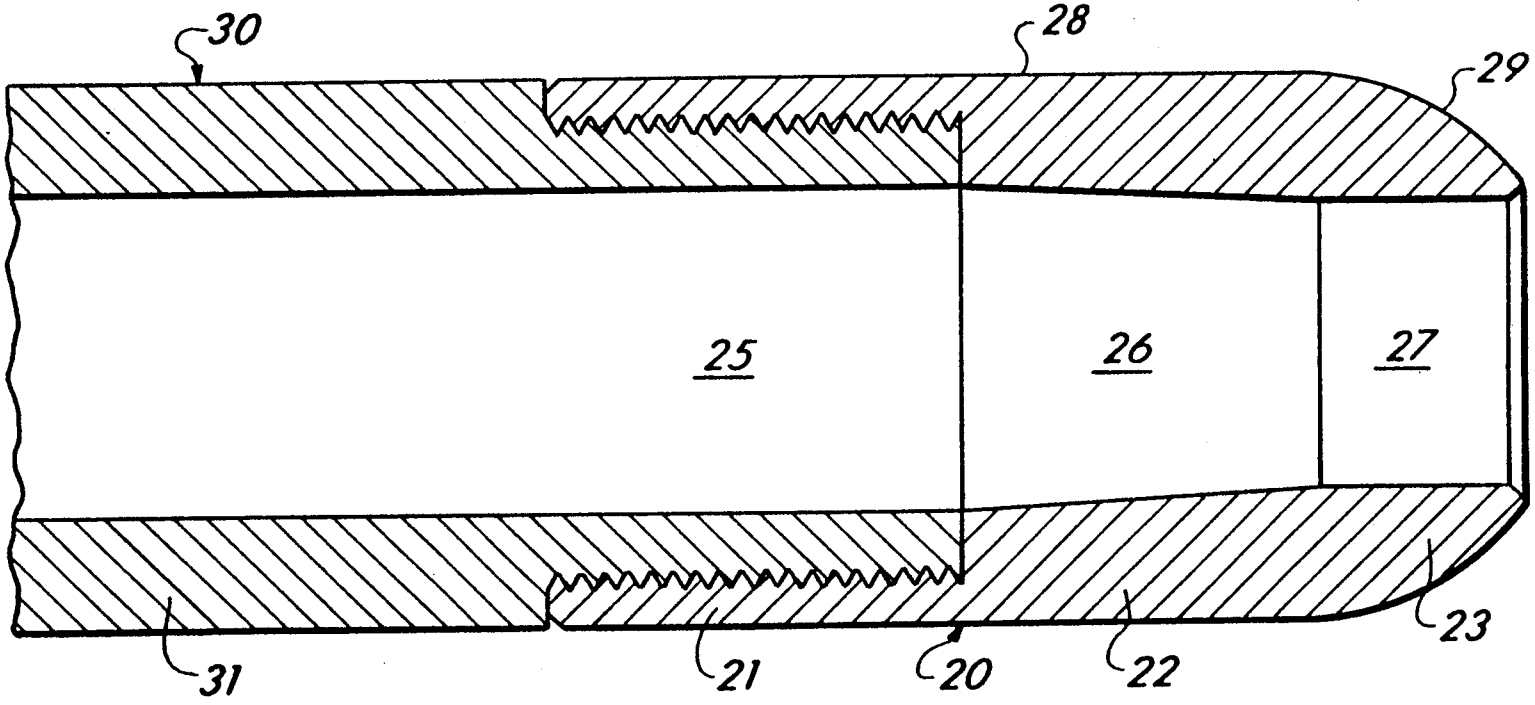
FIG. 2 is a sectional view of a tubing guide shoe utilized in the method of the present invention.

In accordance with the method of the present invention, a tubing guide shoe is releasably secured to a tubing string. The tubing guide shoe useful in the method of the present invention is illustrated in FIG. 2 generally as 20 and is integrally formed of a first portion 21, a second portion 22 and a third portion 23. The first portion is provided with screw threads which are mated with screw threads present on the end joint 31 of a tubing string 30. As thus mated with tubing string 30, a smooth bore 25 is provided through first portion 21. A smaller diameter bore 27 is provided through third portion 23 and is sized to permit passage therethrough of coil tubing or a packer setting plug as hereinafter described in greater detail. Bore 26 is provided through second portion 26 and is tapered to provide a smooth transition between bores 25 and 27 thereby permitting passage of a plug or other apparatus through the tubing guide shoe. The tubing guide shoe has a generally cylindrical peripheral configuration 28 terminating in a rounded end 29 which permits the tubing guide shoe, and therefore the tubing string to which the guide shoe is releasably secured, to pass by irregular surfaces within a horizontal well without becoming stuck. Although the tubing guide shoe may be constructed of any suitable material which is not capable of being drilled as will be evident to a skilled artisan, the guide shoe is preferably constructed of the same material as the joints of tubing are constructed from.

Figure 3:
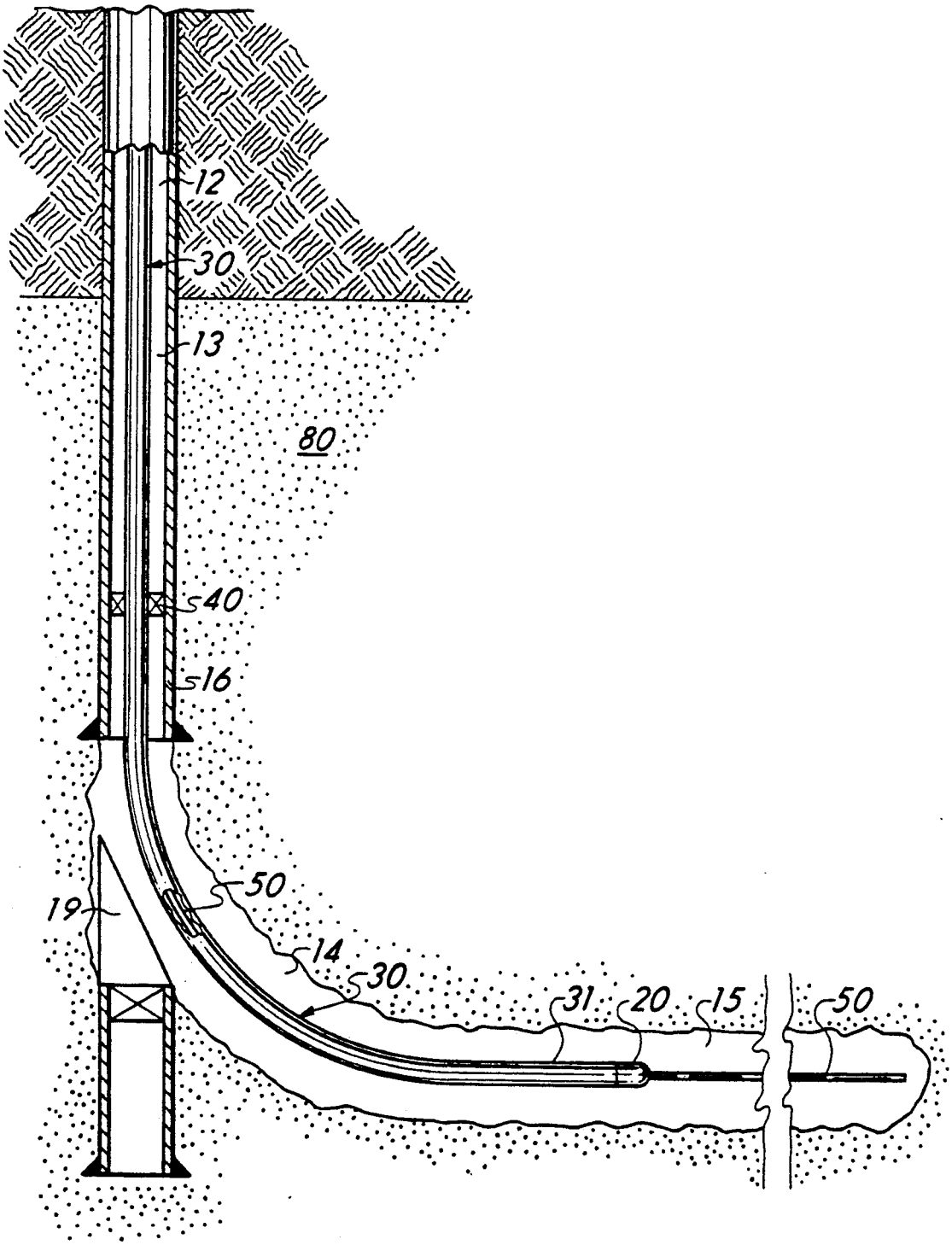
FIG. 3 is a sectional view of a horizontal well which illustrates one embodiment of the method of the present invention.
Figure 4:
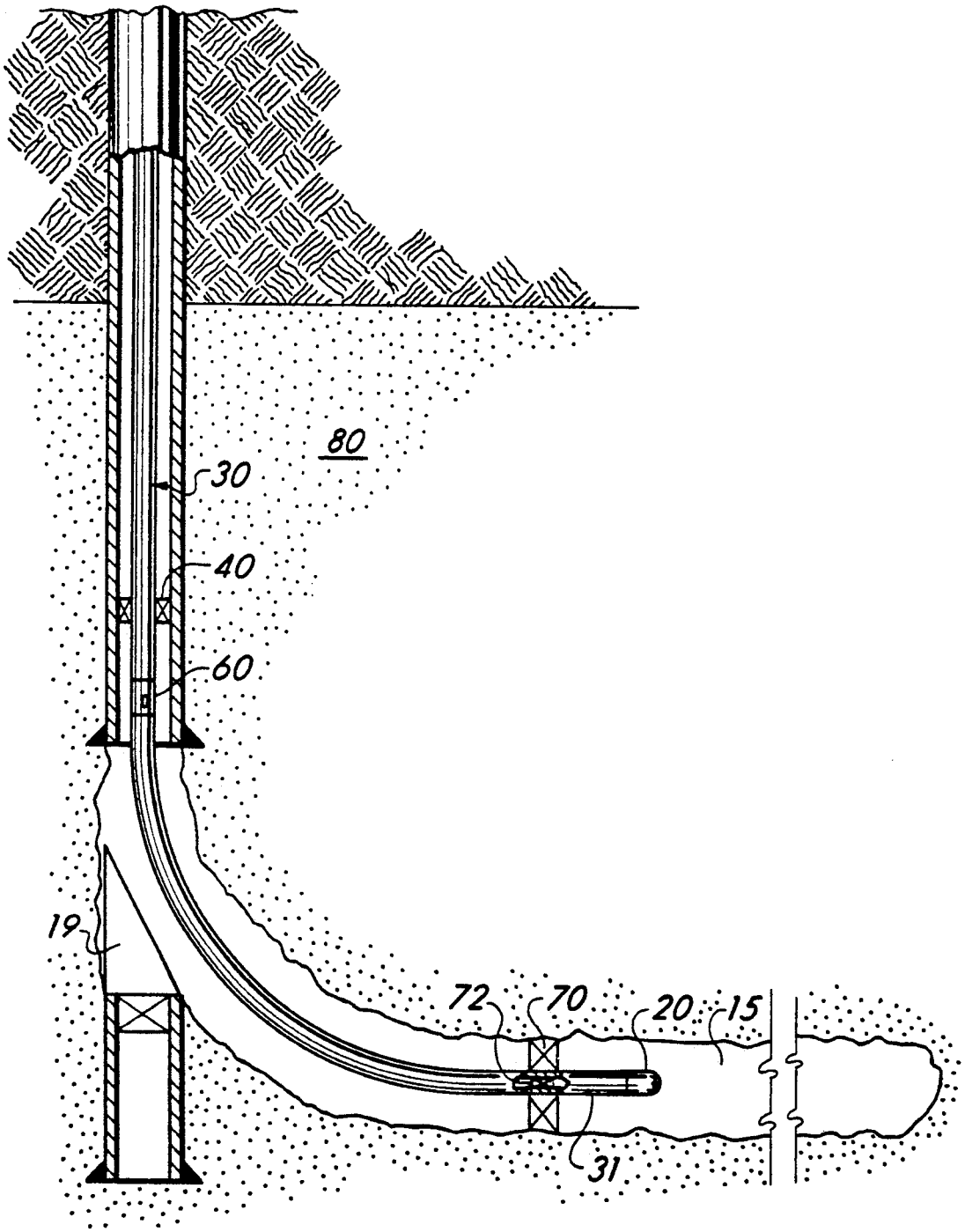
FIG. 4 is a sectional view of a horizontal well which illustrates another embodiment of the method of the present invention.

In accordance with one embodiment of the present invention as illustrated in FIG. 3, a tubing guide shoe 20 is releasably secured to the end joint of tubing 31 of tubing string 30. The guide and tubing string are lowered through the generally vertical section 13 and curve section 14 of horizontal well bore 12 and into the generally horizontal section 15. As previously described, the incongruous nature of horizontal section 15 and/or the bent nature of the tubing string after passing through curve section 14 will usually prevent the tubing string from being inserted past some point intermediate the length of the horizontal section 15. A mechanical production packer 40 is secured to tubing string 30 and is mechanically expanded within the generally vertical section 13 of the well bore to provide a seal between tubing string 30 and casing 16. Thereafter, coil tubing 50 having a diameter smaller than that of tubing string 30 and bores 25, 26 and 27 through tubing guide shoe 20 is inserted through tubing string 30 and passed through tubing guide shoe 20. As utilized throughout the specification, "coil tubing" includes both continuous tubing and a tubing string made up from joints of tubing which are coupled together. Coil tubing 50 is inserted to the proximate end of the generally horizontal section 15 or to any desired point intermediate the length of generally horizontal section 15. Thereafter, a treating fluid is injected via coil tubing 50 and into the generally horizontal section 15. As the treating fluid is continually injected via tubing string 50, the tubing string preferably is uniformly withdrawn from the portion of generally horizontal section 15 extending beyond tubing guide shoe 20. In this manner, better distribution of the treating fluid along the length of the generally horizontal section 15 can be achieved. This method is especially applicable to acidizing the subterranean hydrocarbon-bearing formation surrounding the generally horizontal portion of a horizontal well. However, as utilized throughout the specification, "treating fluid" includes stimulating fluids, including acidizing and fracturing fluids, gelation solutions, fluids utilized to remove or inhibit accumulation, scale, algae, miscellaneous formation fines or mixtures thereof and any other type of fluid conventionally injected into a well bore and/or into a subterranean formation penetrated by a well.

Figure 5:
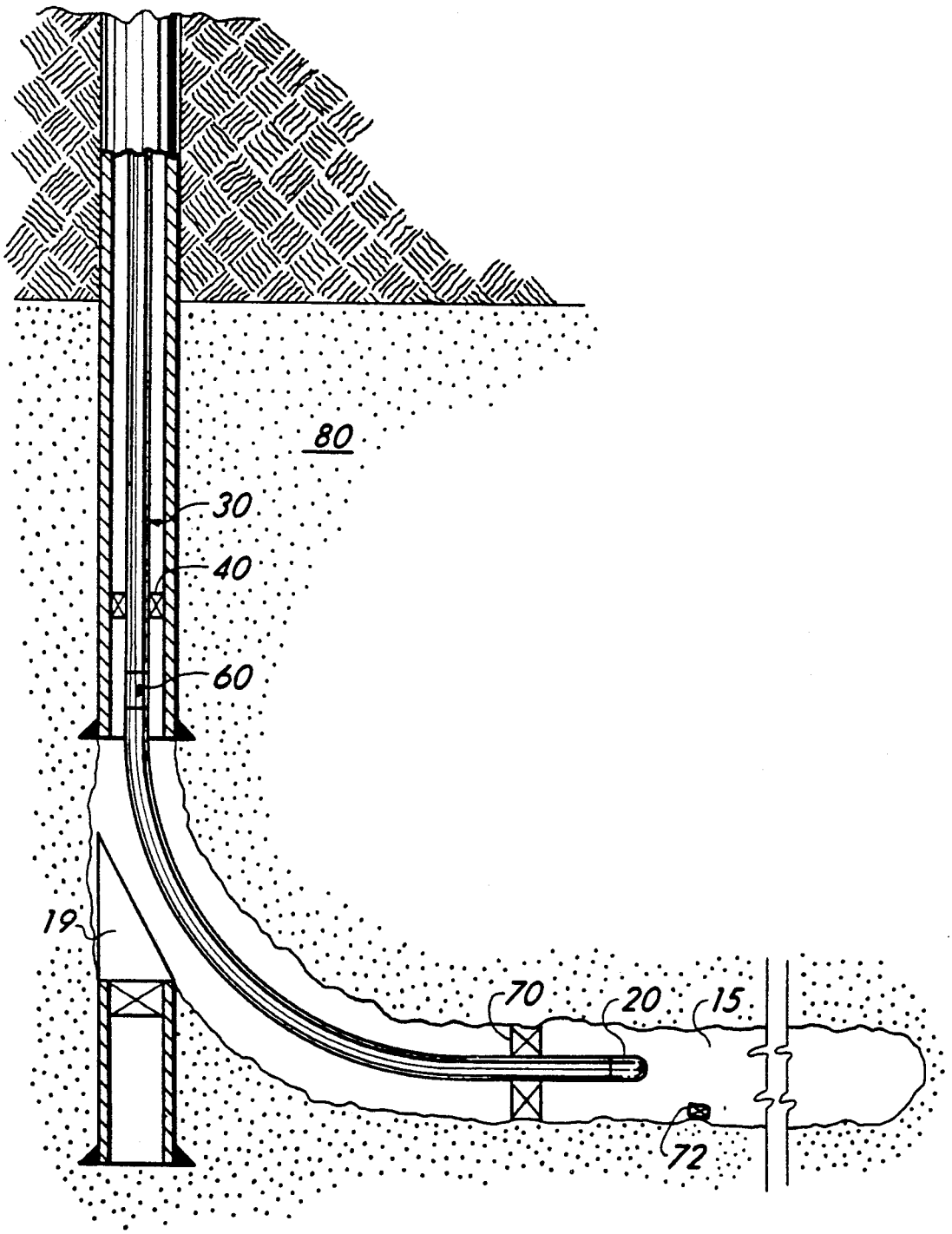
FIG. 5 is a sectional view of a horizontal well which illustrates the well after application of the method of the present invention and equipped for producing liquid hydrocarbons from a subterranean formation.

In another embodiment of the method of the present invention, tubing string 30 having a tubing guide shoe 20 secured to the end joint 31 thereof and a conventional ported "J" nipple 60 secured between joints of the tubing string near the end thereof is positioned within a horizontal well bore as described above. The structure and operation of a conventional "J" nipple, such as those manufactured by Baker Service Tools, Inc. under the designation Model "J" Ported Seating Nipple, will be readily understood by a skilled artisan. Mechanical production packer 40 is set as also previously described. Thereafter, a hydraulic packer 70 which is positioned between ported "J" nipple 60 and tubing guide shoe 20 is set by increasing fluid pressure within tubing string 30. As the fluid pressure is increased, hydraulic packer 70 is expanded into sealing engagement with the face of the generally horizontal section 15 of well bore 12. Once the packer is fully set, the increased pressure upon an internal plug within the packer assembly 70 shears a pin (not illustrated) holding plug 72 in position. Once this pin is sheared, fluid pressure forces plug 72 through tubing string 30, through bores 25, 26 and 27 of guide shoe 20 and into the generally horizontal section 15 of well bore 12. Once hydraulic packer 70 is fully set, a treatment solution such as a gelation solution may be injected through tubing string 30, ported "J" nipple 60 and into contact with the well bore face and subterranean formation surrounding curve section 14 to render this face and the surrounding formation impervious to fluid flow. Gelation solutions which are suitable for this purpose are described in U.S. Pat. No. 4,722,397 which is incorporated herein by reference. This embodiment of the method of the present invention is usually applied to the curve section of a horizontal well to restrict the flow of unwanted fluids, such as gas or water, into the horizontal well during production of liquid hydrocarbons from the formation. As illustrated in FIG. 5, upon completion of the treatment fluid injection, the ported "J" nipple is closed in a manner which is evident to the skilled artisan to permit passage of fluid produced from the formation through guide shoe 20 and tubing string 30 to the surface.

While the foregoing preferred embodiments of the invention have been described and shown, it is understood that the alternatives and modifications, such as those suggested and others, may be made thereto and fall within the scope of the invention.

I claim:

1. A method of variably and selectively positioning coil tubing in a horizontally drilled well having a generally vertical section, a curve section and a generally horizontal section, said method comprising:

securing a generally hollow tubing guide shoe to one end of a tubing string;

inserting said tubing guide shoe and a portion of said tubing string through said generally vertical section and said curve section and into a portion of said generally horizontal section; and inserting coil tubing through said tubing string, a portion of said coil tubing extending through said tubing guide shoe and into the generally horizontal section of said well.

2. The method of claim 1 wherein said portion of said coil tubing extends to proximate the end of said generally horizontal section of said well.

3. The method of claim 2 further comprising:

injecting a fluid through said coil tubing and into said generally horizontal section of said well.

4. The method of claim 3 further comprising:

withdrawing said coil tubing from said well so that said portion of said coil tubing is withdrawn from said generally horizontal section of said well while said fluid is injected into said generally horizontal section of said well.

5. The method of claim 4 wherein said coil tubing is withdrawn from said well at a substantially constant rate.

6. The method of claim 1 wherein said portion of said coil tubing extends to a point intermediate said tubing guide shoe and the end of said generally horizontal section of the well.

7. The method of claim 6 further comprising:

injecting a fluid through said coil tubing and into said generally horizontal section of said well.

8. The method of claim 7 further comprising:

withdrawing said coil tubing from said well so that said portion of said coil tubing is withdrawn from said generally horizontal section of said well while said fluid is injected into said generally horizontal section of said well.

9. The method of claim 8 wherein said coil tubing is withdrawn from said well at a substantially constant rate.

10. A method of stimulating and/or treating a subterranean formation penetrated by a horizontally drilled well having a generally vertical section, a curve section, and a generally horizontal section, said method comprising:

securing a generally hollow tubing guide shoe to one end of a tubing string;

inserting said tubing guide shoe and a portion of said tubing string through said generally vertical section and said curve section and into a portion of said generally horizontal section;

inserting coil tubing through said tubing string, a portion of said coil tubing extending through said tubing guide shoe and into the generally horizontal section of the well; and injecting treating fluid through said coil tubing so as to stimulate and/or to treat said subterranean formation surrounding said generally horizontal section of the well.

11. The method of claim 10 wherein said portion of said coil tubing extends proximate the end of said generally horizontal section of the well.

12. The method of claim 11 further comprising:

withdrawing said coil tubing from said well so that said portion of coil tubing is withdrawn from said generally horizontal section of said well while said fluid is injected into said generally horizontal section of said well.

13. The method of claim 12 wherein said coil tubing is withdrawn from said well at a substantially constant rate.

14. The method of claim 12 wherein said treating fluid is an acidizing fluid.

15. The method of claim 10 wherein said portion of said coil tubing extends to a point intermediate said tubing guide shoe and the end of said generally horizontal section of the well.

16. The method of claim 15 further comprising:

withdrawing said coil tubing from said well so that said portion of coil tubing is withdrawn from said generally horizontal section of said well while said fluid is injected into said generally horizontal section of said well.

17. The method of claim 16 wherein said coil tubing is withdrawn from said well at a substantially constant rate.

18. The method of claim 17 wherein said treating fluid is an acidizing fluid.

19. A method of treating a subterranean formation penetrated by a horizontally drilled well having a generally vertical section, a curve section and a generally horizontal section, said method comprising:

inserting a tubing string having a generally hollow tubing guide shoe secured to the end thereof and a ported "J" nipple positioned intermediate the length thereof through said generally vertical section and said curve section and into a portion of said horizontal section;

sealing an annulus defined between said tubing string and said vertical section to prevent fluid flow therethrough;

sealing an annulus defined between said tubing string and said horizontal section to prevent fluid flow therethrough; and injecting a treatment solution through said tubing string and said ported "J" nipple and into a portion of said formation between the points at which said annulus are sealed.

20. The method of claim 19 wherein said treating solution is a gelation solution and said portion of said formation is rendered impervious to fluid flow.

21. The method of claim 19 wherein said annulus between said tubing string and said horizontal section is sealed by means of a hydraulic packer containing an internal plug.

22. The method of claim 21 wherein after said treating solution is injected into said portion of said formation, said method further comprises:

injecting a fluid into said tubing string at a pressure sufficient to remove said plug from said hydraulic packer and to transport said plug through said tubing string and tubing guide shoe and into said generally horizontal section.

23. The method of claim 22 further comprising:

inserting coil tubing through said tubing string such that a portion of said coil tubing extends through said tubing guide shoe and into the generally horizontal section of the well.

* * * * *